US010328445B2

(12) United States Patent
Hilmersson

(10) Patent No.: US 10,328,445 B2
(45) Date of Patent: Jun. 25, 2019

(54) DEVICE AND METHOD FOR MOVING A JET MEMBER

(71) Applicant: Aquajet Systems Holding AB, Holsbybrunn (SE)

(72) Inventor: Ronnie Hilmersson, Holsbybrunn (SE)

(73) Assignee: Aquajet Systems Holding AB, Holsbybrunn (SE)

( * ) Notice: Subject to any disclaimer, the term of this patent is extended or adjusted under 35 U.S.C. 154(b) by 0 days.

(21) Appl. No.: 15/575,946

(22) PCT Filed: May 9, 2016

(86) PCT No.: PCT/EP2016/060296
§ 371 (c)(1),
(2) Date: Nov. 21, 2017

(87) PCT Pub. No.: WO2016/188725
PCT Pub. Date: Dec. 1, 2016

(65) Prior Publication Data

US 2018/0147589 A1 May 31, 2018

(30) Foreign Application Priority Data

May 25, 2015 (EP) ..... 15169086

(51) Int. Cl.
*E01C 23/08* (2006.01)
*B05B 13/04* (2006.01)
(Continued)

(52) U.S. Cl.
CPC ..... *B05B 13/0415* (2013.01); *B05B 13/005* (2013.01); *E01C 23/08* (2013.01); *E01C 23/128* (2013.01)

(58) Field of Classification Search
CPC ..... E01C 23/08; E01C 23/128; B05B 13/005; B05B 13/04; B05B 13/0415
(Continued)

(56) References Cited

U.S. PATENT DOCUMENTS 4,074,858 A * 2/1978 Burns ..... B05B 12/06 111/127
5,361,993 A * 11/1994 Andersson ..... B05B 13/0405 239/227
(Continued)

FOREIGN PATENT DOCUMENTS

EP 1 029 127 B1 8/2000
GB 1 529 165 A 10/1978

*Primary Examiner* — Gary S Hartmann
(74) *Attorney, Agent, or Firm* — Dilworth & Barrese, LLP

(57) ABSTRACT

A device for moving a jet member (6) having a nozzle comprises a carriage (4) with a base portion (5) to which the jet member is connected. The carriage is movable in a substantially rectilinear first path along a guide member (3). The connection of the jet member to the base portion provides a movability of the jet member (6) with respect to the base portion (5) and by that said carriage comprising a movability of the jet member for moving an impact point of the jet in a second path perpendicularly to said first path. A control unit is controlling a driving arrangement to combine a movement of the carriage along the guide member (3) and a movement of the jet member with respect to the base portion of the carriage so as to make an impact point of the jet on a said layer to travel with a constant speed over the layer.

11 Claims, 7 Drawing Sheets

(51) Int. Cl.
*B05B 13/00* (2006.01)
*E01C 23/12* (2006.01)

(58) Field of Classification Search
USPC ..... 404/84.05, 90, 93, 94
See application file for complete search history.

(56) References Cited

U.S. PATENT DOCUMENTS

| | | | | |
|---|---|---|---|---|
| 6,179,519 | B1 * | 1/2001 | Hilmersson | B23Q 1/4804 299/1.5 |
| 6,224,162 | B1 * | 5/2001 | MacNeil | E01C 23/128 239/172 |
| 6,435,620 | B2 * | 8/2002 | MacNeil | E01C 23/128 299/17 |
| 7,029,199 | B2 * | 4/2006 | Mayfield | A63C 19/06 404/84.05 |
| 7,179,018 | B2 * | 2/2007 | Hall | E01C 23/06 175/15 |
| 8,033,641 | B2 * | 10/2011 | Hilmersson | B28D 1/00 347/37 |
| 8,086,360 | B2 * | 12/2011 | Hilmersson | B05B 13/0415 137/899.1 |
| 8,527,111 | B2 * | 9/2013 | Hilmersson | E01C 23/128 239/275 |
| 9,528,228 | B2 * | 12/2016 | Allega | B05B 9/0409 |
| 2006/0006257 | A1 | 1/2006 | Narui | |

* cited by examiner

DEVICE AND METHOD FOR MOVING A JET MEMBER

TECHNICAL FIELD OF THE INVENTION AND BACKGROUND ART

The present invention relates to a device for moving a jet member having a nozzle, said device comprising

- a carriage provided with a base portion to which said jet member is connected,
- a guide member along which said carriage is movable in a substantially rectilinear first path for moving the nozzle of the jet member over a layer to be treated by the jet,
- the connection of said jet member to said base portion providing a movability of the jet member with respect to the base portion and by that said carriage comprising a first movability of the jet member for moving an impact point of said jet in a second path perpendicularly to said first path,
- a driving arrangement configured to move said carriage along said first path and said jet member with respect to said base portion of said carriage, and
- a control unit configured to control said driving arrangement for controlling the movement of said impact point of said jet over a said layer, as well as a method.

This treatment of a material layer is first of all intended to be a material removing treatment. Although the layer may consist of other material a concrete layer is preferably concerned herein. Primarily, the treatment is intended to have the purpose to remove weakened material from the layer. It may then be a question of removing weakened concrete from concrete layers on roads, bridges and a variety of building structures, whereupon the removed concrete may be replaced by new concrete. It is in this connection especially preferred that the treating member is constituted by a jet member so as to direct a high pressure jet of liquid against the material layer. Thus, it is this high pressure jet of liquid which executes the material removing treatment. Preferably, the high pressure liquid consists of water. Although the definition "impact point" is used in this disclosure for the place where the jet hits said layer it is really not a question of a point, but a smaller restricted area on which the jet hits said layer. Said movability of the jet member with respect to the base portion of said carriage normally also includes a pivotability of the jet member around an axis perpendicular to said first path for changing the attack angle, but the present invention is not restricted to the case that a possibility to change the attack angle exists. A desire to change the attack angle is due to the fact that said concrete layers are reinforced by reinforcement bars, normally in a lattice-like structure. By using a small attack angle, i.e. an angle of the jet being substantially perpendicular to the layer to be treated, the material may be removed quickly, but the result of the treatment will not be that uniform. However, by choosing a large attack angle of the jet the jet will easier reach under the reinforcement bars, so that it will be cleaner thereunder and the result of the treatment will be more uniform and the surface treated smooth.

Said first movability is normally accomplished by a pivoting of the jet member around an axis extending in parallel with said first path in the form of oscillations when moving the carriage and by that the jet member along said guide member in said first path and is carried out for obtaining a broader stripe of the layer surface treated by the jet when moving this along said first path. The width of such a stripe treated by the jet member may be in the order of 20-100 mm when the carriage moves along the guide member, which means that the device may then be indexed at a maximum by this width for treating a further stripe of the layer.

This type of oscillations around a said axis in a device of this type is shown in for example EP 1 029 127 B1. It is schematically shown in appended FIG. 1 how the impact point of the jet member moves over the material layer treated when combining a movement along said first path in the direction X with an oscillation around an axis in the direction Y. The speed of travel of said impact point over said layer by these combined movements will differ, since the pivoting will have a neglectable contribution to that speed near the end positions e of said second path and have a significant contribution to that speed in regions therebetween. This means that the exposure time of the layer for said jet member (impact point) will be longer at said end positions resulting in a deeper material removal there resulting in a formation of so called pits or bore holes. These may get a depth of 15-40 mm and a diameter of 10-20 mm, although other figures are possible depending upon the structure of the material treated. It will then be difficult to fill these pits with concrete when subsequently applying new concrete on the layer treated, and unacceptable air pockets or enclosures may then be formed in the bonding area of new concrete to old concrete. Such pockets may be filled by moisture which may result in loosening of the new concrete upon temperature changes. This has to be avoided, which is especially difficult in the case of a material layer in the form of a vertical wall or ceiling treated. It will then be impossible to utilize the gravity to shake the concrete to penetrate into and fill said pits.

SUMMARY OF THE INVENTION

The object of the present invention is to provide a device and a method of the type defined in the introduction being improved with respect to such devices and methods already known.

This object is with respect to the device obtained by providing such a device with the feature herein.

By having said control unit configured to control the driving arrangement to combine a movement of the carriage along the guide member and a movement of the jet member with respect to the base portion of the carriage so as to make said impact point of said jet on a said layer to travel with a constant speed over said layer, the exposure time for said impact point of the jet will be the same everywhere along the combined path along which said impact point moves over a said layer. This means that the formation of said pits and the disadvantages of the presence thereof may be avoided by simple means.

According to an embodiment of the invention the control unit is configured to control the driving arrangement to obtain a speed of the movement of said jet member along said second path having a maximum in a mid-region along this path and decreasing towards end positions of said second path for increasing after returning from a said end position and to compensate a change of speed of said impact point along said second path caused thereby by means of a corresponding opposite change of speed of the impact point along said first path. Thus, such a compensation means that the speed of the impact point along said first path will be increased close to said end positions of the movement along said second path, which is a preferred way of obtaining a travel of the impact point with a constant speed over the layer without exerting the equipment for considerable stress. The movement of the impact point will by this describe a pattern looking like a rounded square wave making it possible to have a smaller overlap when carrying out a said indexing, so that a certain area may then be treated in a shorter time.

According to another embodiment constituting a further development of the embodiment last mentioned said movability of the jet member with respect to said base portion of the carriage comprises a second movability of the jet member along said first path, and the control unit is configured to control said driving arrangement to move the jet member with respect to said base portion along said first path with a frequency being twice the frequency of a movement of the jet member with respect to the base portion along said second path and the jet member to be in a mid-region of the movement according to said second movability with a maximum speed of this movement and to move in the direction of movement of said carriage along said first path at said end positions of the movement of the jet member according to said first movability. It has turned out that this type of moving of the jet member with respect to the base portion and by that the carriage when the carriage is moving along said guide member will perfectly result in obtention of the aim of the invention, since the movement of the jet member with respect to the base portion of the carriage along said first path will at the end positions of the movement along said second path result in a contribution of the movement of the jet member with respect to the carriage to the movement along said first path where it is really needed and counteract such a movement where the jet member moves as fastest around said first axis.

According to an embodiment of the invention the control unit is configured to control said driving arrangement to obtain a movement of said impact point on a said layer in a 8-like path through movement of the jet member with respect to said base portion according to said first and second movabilities overlapped by a movement of said carriage along said first path. This is a suitable way of obtaining a constant speed of travel of said impact point of the jet over a said layer.

According to another embodiment of the invention the control unit is configured to control the driving arrangement to move said carriage to and fro along said first path and to displace said movement according to said second movability by half a period upon obtaining an extreme position and turning of the carriage to ensure that the jet member is moved according to said second movability in the direction of movement of said carriage along said first path at said end positions of the movement of the jet member according to said first movability irrespectively of the direction of movement of the carriage. It is by the displacement of the movement according to said second movability by half a period upon obtaining an extreme position and turning of the carriage ensured that the movement of the jet member with respect to the carriage and the movement of the carriage along said guide member will always be combined to obtain a constant speed of travel of the impact point of said jet member over said layer irrespectively of in which direction the carriage is moved along the guide member.

According to another embodiment of the invention the control unit is configured to control the driving arrangement to obtain a change of the speed of the movement of said impact point along said first path by varying the speed of the carriage along said guide member to increase when the speed along said second path caused by movement according to said first movability decreases and conversely.

According to another embodiment of the invention said first movability is a pivotability of the jet member around a first axis extending in parallel with said first path. This constitutes an advantageous way of achieving said first movability.

According to another embodiment of the invention said second movability is a pivotability of the jet member around a second axis extending perpendicularly to said first path. This constitutes an advantageous way of achieving said second movability.

According to another embodiment of the invention said movability of the jet member with respect to said base portion comprises a pivotability of the jet member around a third axis extending perpendicularly to aid first path so as to change the attack angle of said jet upon a said layer, and according to a further development of this embodiment said control unit is configured to control the driving arrangement to compensate for a change of speed of said impact point caused by movement of the jet member according to said first movability by a pivoting of said jet member around said third axis changing said attack angle.

According to another embodiment the invention the device comprises a displacing arrangement for displacing, during pivoting motion of the jet member, the jet member in relation to the base portion so that the mouth of the nozzle of the jet member describes a motion in substantially one and the same plane so as to obtain a constant distance of said mouth of the nozzle to a layer to be treated by said jet. Such a constant distance between the nozzle of the jet member and the material layer surface treated ensures a regular treatment of said material layer and these features are present in a device disclosed in EP 1 029 137 B1 mentioned above.

The object of the invention is with respect to the method obtained by providing a method with the features listed in the appended method claim. The advantages of such a method appear clearly from the above discussion of the device according to the invention and embodiments thereof.

The invention also relates to a computer program, a computer program product, an electronic control unit as well as a use of a device according to the invention for material removing treatment of a material layer, especially a concrete layer.

Further advantages and advantageous features of the invention will appear from the description following below.

BRIEF DESCRIPTION OF THE DRAWINGS

With reference to the appended drawings, below follows a specific description of a device and a method according to an embodiment of the present invention.

In the drawings.

DETAILED DESCRIPTION OF AN EMBODIMENT OF THE INVENTION

Figure 1:
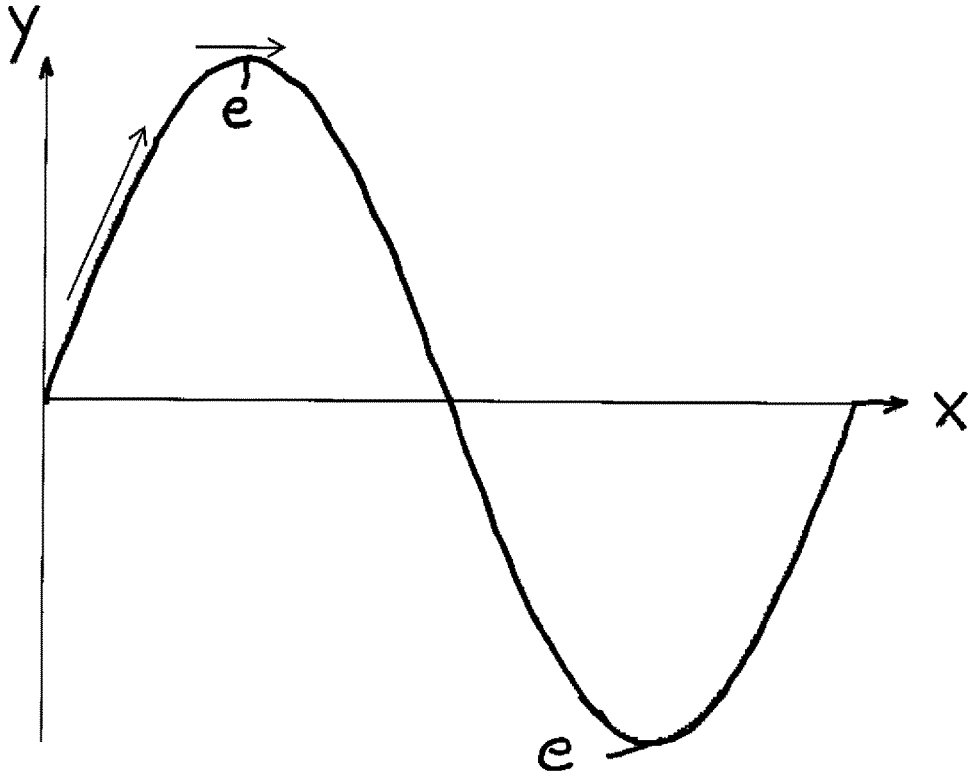
FIG. 1 is a graph showing how an impact point of a jet member of a known device is moving over a layer treated thereby.
Figure 2:
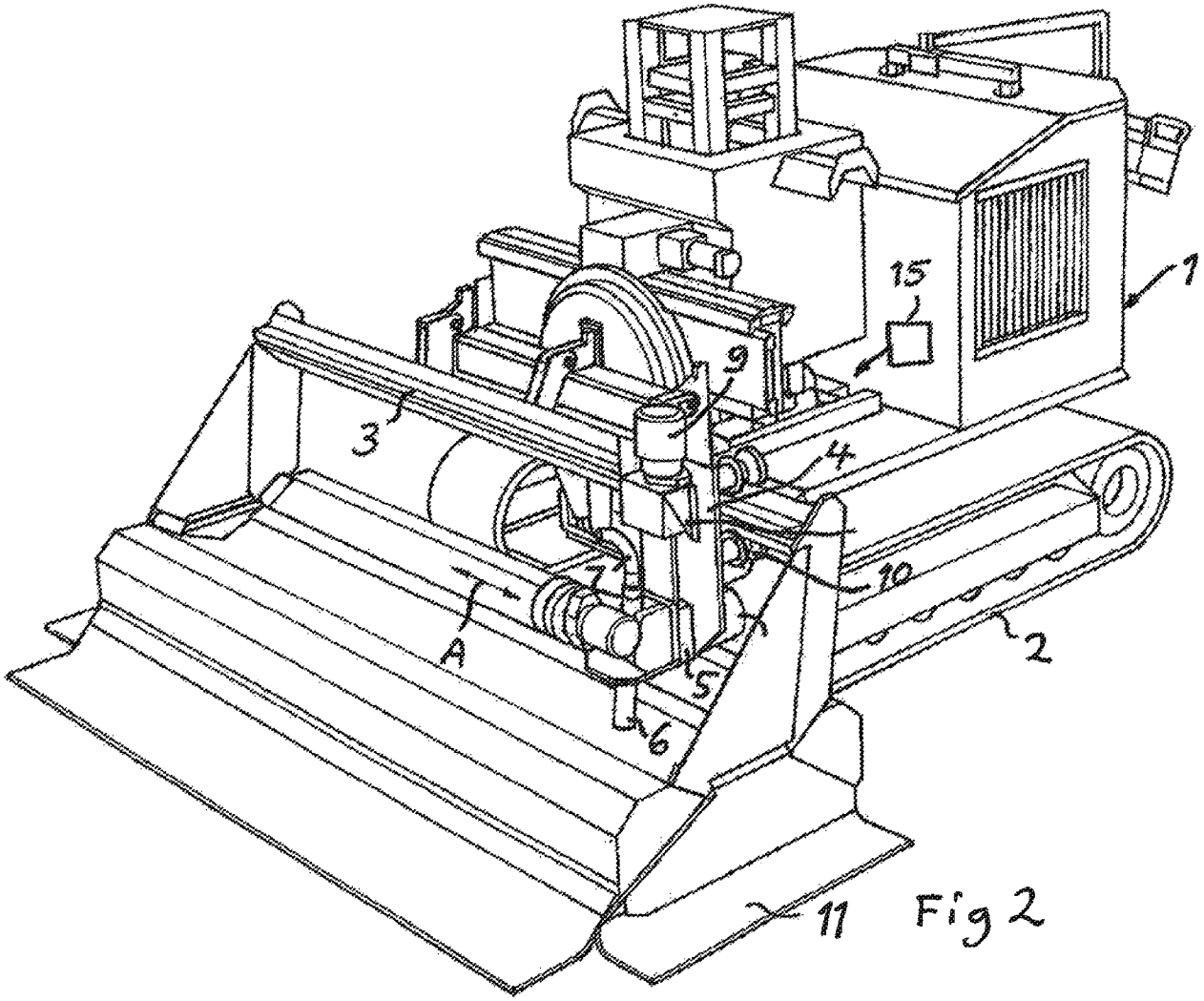
Fig 2 Prior Art
FIG. 2 is a schematic perspective view of a mobile unit, in which the device according to the invention is implemented.

The general structure of a device according to the present invention and how it may be used will first of all be described with reference made to FIGS. 2-5 showing a said device arranged on a mobile unit 1, which has the character of a vehicle movable on the bedding, for instance a concrete layer, to be treated. The vehicle is indicated as being of crawler type with two driving tracks 2.

An elongated guide member 3 of the device is arranged on the vehicle 1, and a carriage 4 is movable in a substantially rectilinear first path to and fro along said guide member for carrying out so called traverses. A base portion 5 constitutes a part of the carriage 4. A tube-like jet member 6 or lance is arranged on the base portion 5 for directing a high pressure jet of liquid against the bedding. The guide member in operation is intended to make an angle preferably substantially a right angle, with a motion direction of the vehicle. The jet member 6 communicates through a conduit 7 with a source for delivering high pressure liquid, especially water, to the jet member. This high pressure source may be arranged on the vehicle 1 or on a separate carriage or the like.

A connection of the jet member 6 to the base portion 5 provides a movability of the jet member with respect to the base portion and by that said carriage comprising a pivotability of the jet member around a third axis 8 (see simplified FIG. 3) for changing the attack angle of said jet upon the layer to be treated. This axis 8, in the example, is extending substantially transversally to the length direction of the guide member 3 and more exactly substantially in right angle to a plane, in which plane the guide member 3 is located and which plane extends perpendicularly to the material layer to be treated.

A driving arrangement configured to move the carriage 4 along the guide member and the jet member with respect to the base portion of the carriage comprises a first drive means in the form of an hydraulic motor 9 arranged for moving the carriage along the guide member 3 as indicated by the arrows A, whereas a second drive means in the form of an hydraulic motor 10 is arranged for pivoting the jet member 6 with respect to the base portion for changing the attack angle of the jet upon the layer to be treated. Such pivoting is substantially carried out in the turning zones close to the respective end position of the carriage 4 along said rectilinear path.

Figures 3, 4, 5:
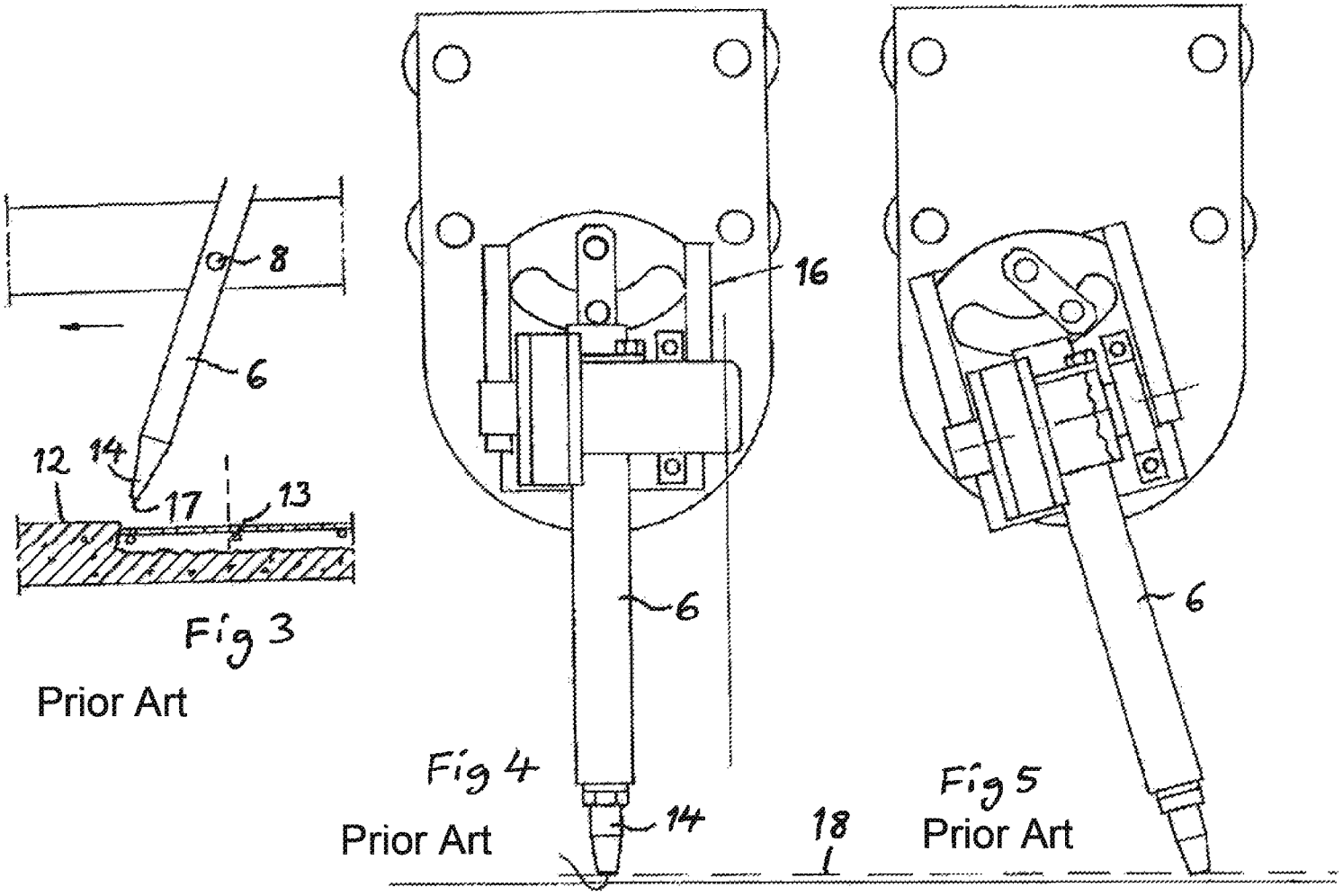
Fig 5 Prior Art
Fig 4 Prior Art
Fig 3 Prior Art
FIG. 3 is a schematic view of a jet member of a prior art device incorporating the present invention, which is moving along a layer treated by the jet thereof and is viewed perpendicularly to the guide member, along which a carriage is movable.
FIGS. 4 and 5 are more detailed views of the carriage in FIG. 3 with base portion of the device according to the present invention in different function positions.

Means, such as rubber rollers 11 are arranged to bear on the bedding and restricting a space within which treatment is carried out for protecting the surroundings of the vehicle 1 against material removed by the jet of the jet member 6 and thrown away. It is shown in FIG. 3 how the jet member 6 is moving to the left in a transversal movement while removing material, here concrete, from the bedding 12. The concrete layer is reinforced by a lattice-like grid of reinforcement bars 13, and by keeping the jet member 6 inclined the jet will reach under these reinforcement bars. The choice of the inclination direction of the jet member is due to the required treatment result and the character of the material. In the case shown in FIG. 2 the nozzle 14 of the jet member points in the motion direction of the carriage, and it will do so also when the carriage has changed moving direction.

A control unit 15 is configured to control said driving arrangement for controlling the movement of the impact point of the jet from the jet member over a said layer and is for example an electronic control unit in the form of a suitable computer provided with suitable software. The hydraulic motor 9 may be controlled to move the carriage 4 one or several times, i.e. in one or more traverses, to and fro between said end positions before said driving tracks are controlled to move the entire vehicle and by that the carriage 4 with the jet member 6 a step forwards, so called indexing, for treating a new area of the layer to be treated.

It is schematically illustrated in FIGS. 4 and 5 how guide means 16 are arranged to guide the jet member to have said third pivot axis 8 thereof displaced with respect to said base portion 5 of the carriage during pivoting of the jet member with respect to the base portion so that the mouth 17 of the nozzle of the jet member describes a motion in substantially one and the same plane 18 substantially perpendicular to the plane in which the jet member is pivoting. As seen, this plane 18, during operation is located directly above the layer 12 to be subjected to treatment. The construction of the guide means for obtaining this motion of said mouth 17 and the plane 18 may be the same as the one described in EP 1 029 127 B1 while making reference to FIG. 8-10, and will not be disclosed more in detail here.

The movability of the jet member 6 with respect to the base portion 5 of the carriage also comprises a first movability in the form of a pivotability of the jet member around a first axis 19 extending in parallel with said first path moving an impact point of the jet in a second path perpendicularly to said first path by pivoting the jet member around said first axis 19 in a so called oscillation resulting in a broader stripe of the layer surface treated by the jet when moving this along said first path. This is what has been explained in the introduction while making reference to FIG. 1 and is well known. The features of the device described so far are already known for devices of this type, and the new features of the device according to the invention will now be explained while making reference especially to FIGS. 6-8.

Figure 6:
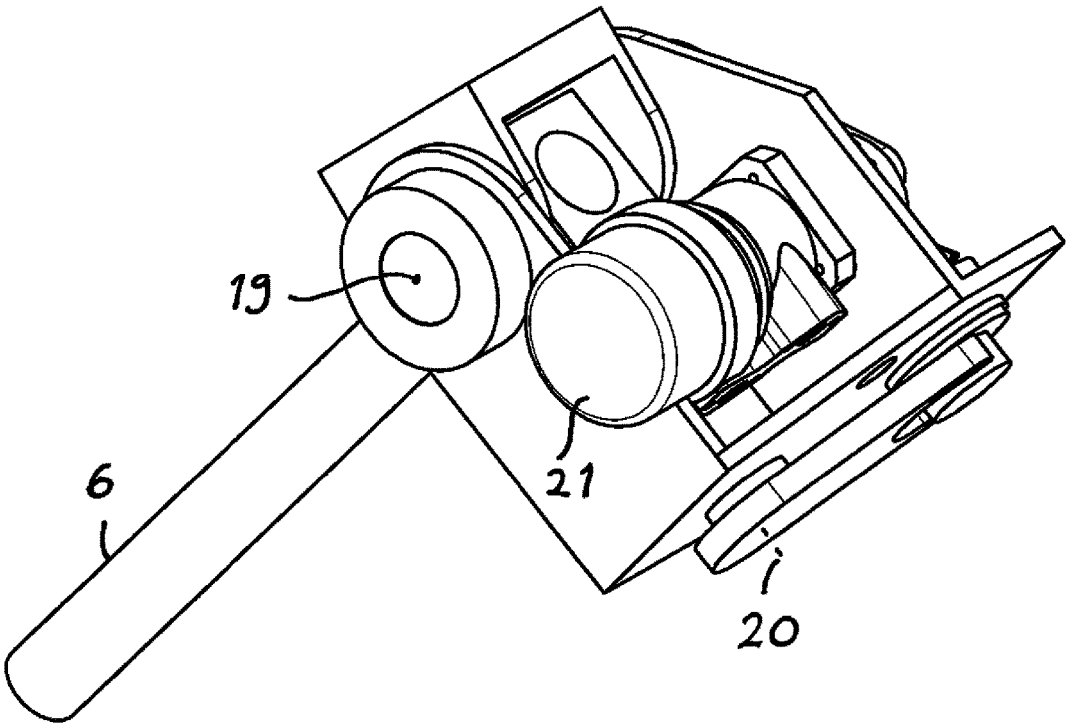
FIG. 6-8 are views from different directions of parts of a driving arrangement of a device according to an embodiment of the invention for obtaining a movement of a jet member thereof with respect to a base portion of a carriage of the device.
Figure 7:
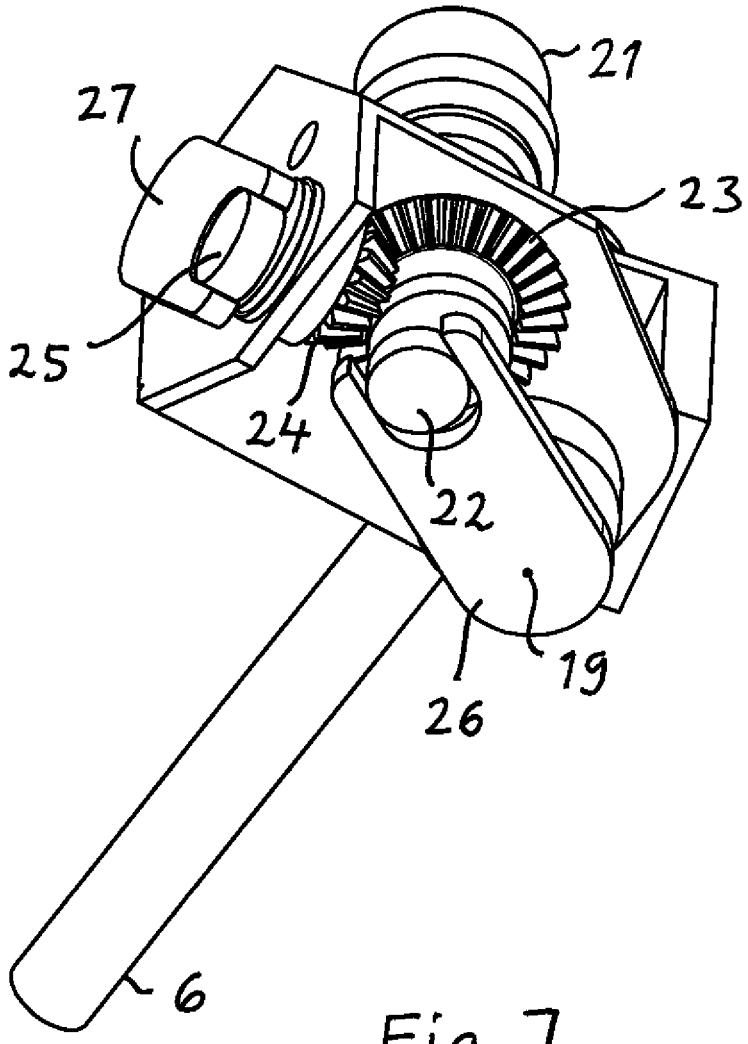
Figure 8:
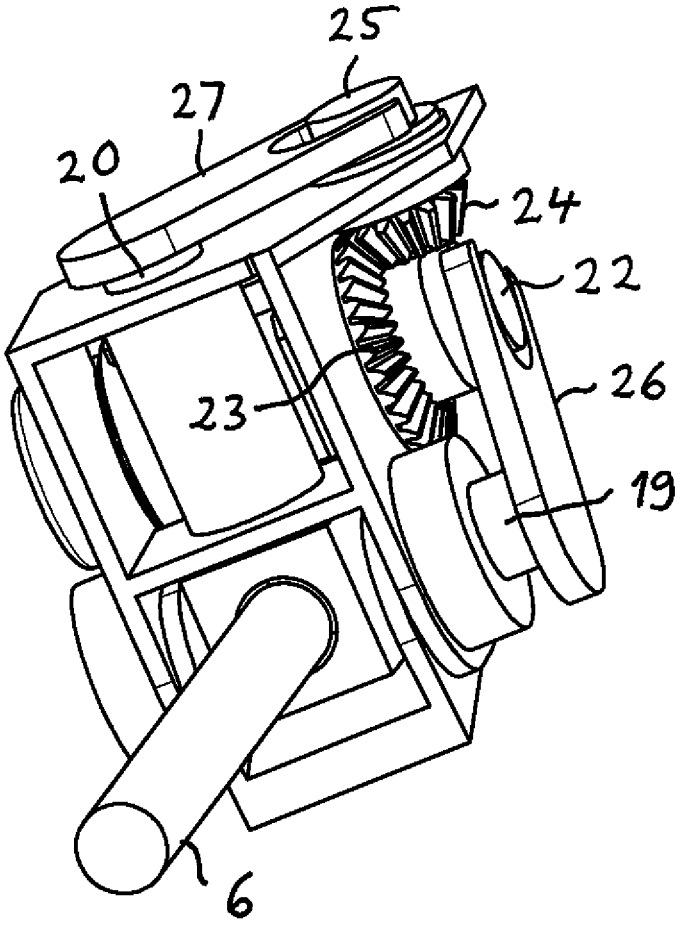

The movability of the member 6 with respect to the base portion 5 of the carriage comprises a second movability in the form of a further pivotability of the jet member 6 around a second axis 20 extending perpendicularly to said first axis. The control unit 15 is configured to control a driving arrangement to pivot the jet member around said second axis 20 with a frequency being twice the frequency of a pivoting of the jet member around said first axis 19 and to be in a mid-region of pivoting around said second axis with a maximum speed of this pivoting and to move in a direction of movement of said carriage along said first path at end positions of the pivoting of the jet member around said first axis. How this may be obtained is illustrated in FIG. 6-8. It is shown how the driving arrangement comprises a motor 21 rotating a member with an eccentric projection 22 and a worm gear 23 engaging with a worm gear 24 of another member having another eccentric projection 25. The movement of the two eccentric projections 22 and 25 caused by a rotation of an output shaft of the motor 21 are transferred by a respective link 26, 27 to a pivoting motion of the jet member around said first axis 19 and said second axis 20, respectively. The two worm gears 23, 24 are designed so that the jet member 6 will pivot around said second axis 20 with a frequency being twice the frequency of pivoting thereof around the first axis 19. Furthermore, the end positions of the pivoting around said first axis 19 may typically be 20 mm-100 mm apart and half as much, i.e. 10 mm to 50 mm, for the pivoting around said second axis 20.

Figure 9:
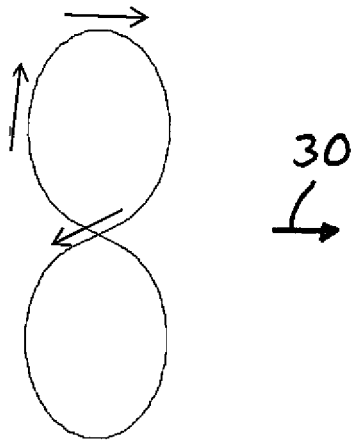
FIG. 9 is a simplified view showing how an impact point of the jet member shown in FIG. 6-8 will move over a layer to be treated would said carriage of the device stand still.

It is shown in FIG. 9 how an impact point of said jet member 6 would move over a layer to be treated through such a combined pivoting around the first 19 and the second 20 axis would the carriage stand still. It is shown how the impact point move in an 8-like path in the form of a movement along a so called lemniscate. The control unit 15 is configured to ensure that the movement of the jet member with respect to the base portion of the carriage is in the direction of movement of the carriage along said first path at the end positions of the pivoting of the jet member around said first axis, which means that the way the 8 is followed in FIG. 9 has to be combined with a movement along said first path in the direction of the arrow 30.

Figure 10:
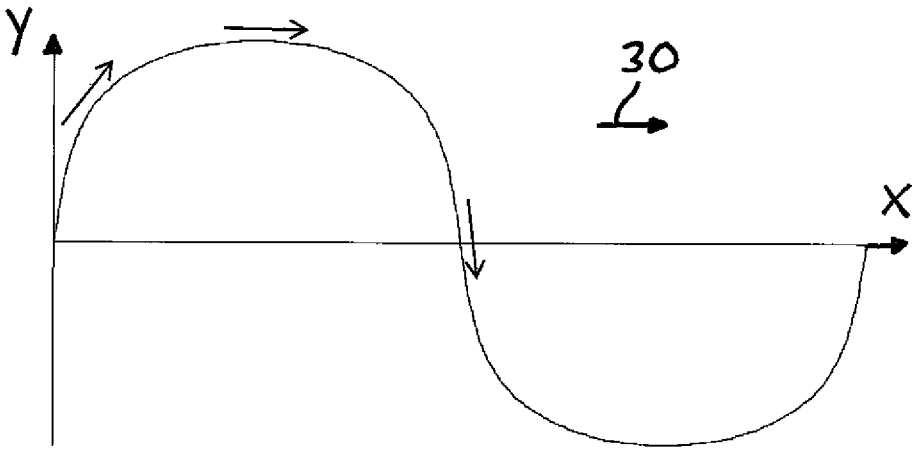
FIG. 10 is a graph corresponding to FIG. 1 showing how a said impact point will travel over a said layer when combining the movement pattern shown in FIG. 9 and a movement with a constant speed along a said first path.

The control unit 15 is configured to control the driving arrangement to combine a movement of the carriage along said guide member and a movement of the jet member 6 with respect to the base portion 5 of the carriage 4 illustrated in FIG. 9 so as to make the impact point of the jet on a layer to be treated to travel with a constant speed over this layer. FIG. 10 shows how said impact point will move when these movements are combined. The result will be a pattern looking like a rounded square wave along which the impact point moves with a constant speed. The control unit 15 is programmed to control the driving arrangement to displace the pivoting around the second axis 20 by half a period upon obtaining an extreme position and turning of the carriage to ensure that the jet member is moved by the pivoting around said second axis 20 in the direction of movement of said carriage along said first path at said end positions of the pivoting of the jet member around said first axis 19 irrespectively of the direction of movement of the carriage.

This type of movement of the impact point of the jet member over a layer to be treated will efficiently avoid formation of so called pits, since the exposure time for the impact point will not be changed when this moves over a said layer.

The invention is of course not in any way restricted to the embodiment described above, but many possibilities to modifications thereof would be apparent to a person with ordinary skill in the art without departing from the scope of the invention as defined in the appended claims.

As already mentioned, the surface layer to be treated may have any orientation and may for instance have a vertical extension, such as being a part of a wall of a building or a pier of a bridge.

The device has not to be arranged on a mobile unit, but the guide member may for instance be arranged on a frame applied to a wall to be treated by a said jet and moved along said frame or moved by moving the frame for so called indexing.

Said third axis may be the same as said second axis, and this is advantageous in the case that a device has a said displacing arrangement creating a motion of the nozzle of the jet member in substantially one and the same plane so as to obtain a constant distance of the mouth of the nozzle to a layer to be treated by a jet of the jet member.

Said first and second movability of the jet member with respect to a base portion of said carriage may be other than the pivotabilities in the device described above, such as translatory movements of the jet member with respect to the carriage, although said pivotabilities are easy to accomplish with a high operation reliability.

The invention claimed is:

1. A device for moving a jet member (6) having a nozzle, said device comprising a carriage (4) provided with a base portion (5) to which said jet member is connected, a guide member (3) along which said carriage is movable in a substantially rectilinear first path for moving the nozzle (14) of the jet member (6) over a layer to be treated by the jet, the connection of said jet member (6) to said base portion (5) providing movability of the jet member with respect to the base portion, said carriage comprising a first movability of the jet member (6) for moving an impact point of said jet in a second path perpendicularly to said first path, a driving arrangement (9, 10, 21) configured to move said carriage along said first path and said jet member with respect to said base portion of said carriage, and a control unit (15) configured to control said driving arrangement for controlling the movement of said impact point of said jet over said layer, wherein the control unit (15) is configured to control said driving arrangement to combine movement of said carriage along said guide member (3) and movement of said jet member (6) with respect to said base portion (5) of said carriage to make said impact point of said jet on said layer to travel with a constant speed over said layer, the control unit (15) is configured to control the driving arrangement to obtain a speed of the movement of said jet member (6) along said second path having a maximum in a mid-region along this path and decreasing towards end positions of said second path for increasing after returning from said end position and compensate a change of speed of said impact point along said second path caused thereby by a corresponding opposite change of speed of the impact point along said first path, said movability of the jet member (6) with respect to said base portion (5) of the carriage (4) comprises a second movability of the jet member along said first path, and the control unit (15) is configured to control said driving arrangement (21) to move the jet member with respect to said base portion (5) along said first path with a frequency being twice the frequency of a movement of the jet member with respect to the base portion along said second path and the jet member to be in a mid-region of the movement according to said second movability with a maximum speed of this movement and move in the direction of movement of said carriage (4) along said first path at said end positions of the movement of the let member according to said first movability, said first movability is a pivotability of the jet member (6) around a first axis (19) extending in parallel with said first path, and said second movability is a pivotability of the let member (6) around a second axis (20) extending perpendicularly to said first path.

2. A device according to claim 1, wherein the control unit (15) is configured to control said driving arrangement to obtain a movement of said impact point on a said layer in a 8-like path through movement of the jet member (6) with respect to said base portion (5) according to said first and second movabilities overlapped by a movement of said carriage along said first path.

3. A device according to claim 1, wherein the control unit (15) is configured to control the driving arrangement to move said carriage (4) to and fro along said first path and displace said movement according to said second movability by half a period upon obtaining an extreme position and turning of the carriage (4) to ensure the jet member (6) is moved according to said second movability in the direction of movement of said carriage along said first path at said end positions of the movement of the jet member according to said first movability irrespectively of the direction of movement of the carriage.

4. A device according to claim 1, wherein the control unit (15) is configured to control the driving arrangement to obtain a change of the speed of the movement of said impact point along said first path by varying the speed of the carriage (4) along said guide member (3) to increase when the speed along said second path caused by movement according to said first movability decreases and conversely.

5. A device according to claim 1, wherein said movability of the jet member (6) with respect to said base portion comprises a pivotability of the jet member around a third axis (8) extending perpendicularly to said first path to change the attack angle of said jet upon said layer.

6. A device according to claim 5, wherein said control unit (15) is configured to control the driving arrangement to compensate for a change of speed of said impact point caused by movement of the jet member according to said first movability by pivoting of said jet member (6) around said third axis (8) changing said attack angle.

7. A device according to claim 1, wherein the device comprises a displacing arrangement for displacing, during pivoting motion of the jet member (6), the jet member in relation to the base portion (5) so that the mouth (17) of the nozzle (14) of the jet member describes a motion in substantially one and the same plane to obtain a constant distance of said mouth of the nozzle to a layer to be treated by said jet.

8. A device according to claim 1, configured for material removing treatment of a material layer.

9. A device according to claim 1, wherein said driving arrangement (9, 10, 21) comprises a motor (21), a first eccentric projection (22) and a first worm gear (23) rotatably engaging the motor (21), a second worm gear (24) engaging the first worm gear (23) and a second eccentric projection (25) coupled to the second worm gear (24), and a first link (26) coupling the first eccentric projection (22) to the first axis (19) and a second link (27) coupling the second eccentric projection (25) to the second axis (20).

10. A device according to claim 8, configured for removing treatment of a concrete layer.

11. A method for moving a jet member (6) having a nozzle and connected to a base portion (5) of a carriage (4) comprising the steps of moving said carriage (4) along a guide member (3) in a substantially rectilinear first path for moving the nozzle of the jet member over a layer to be treated by the jet, moving the jet member (6) with respect to said base portion (5) at least for moving an impact point of said jet in a second path perpendicular to said first path, and controlling a movement of said carriage (4) along said guide member (3) and a movement of said jet member (6) with respect to said base portion (5) of said carriage to combine these movements to make said impact point of said jet on said layer to travel with a constant speed over said layer, wherein said jet member (6) is moved with respect to said base portion (5) around a first axis (19) extending in parallel with said first path and a second axis (20) extending perpendicularly to said first path.

* * * * *